US009995466B2

(12) United States Patent
SanFacon et al.

(10) Patent No.: US 9,995,466 B2
(45) Date of Patent: Jun. 12, 2018

(54) CONCEALED CONNECTION SYSTEM FOR LUMINAIRES

(71) Applicant: Focal Point, LLC, Chicago, IL (US)

(72) Inventors: Michael David SanFacon, Naperville, IL (US); Krutin S. Desai, Chicago, IL (US); Casey Chung, Bloomingdale, IL (US); Ken Czech, Naperville, IL (US)

(73) Assignee: Focal Point, LLC, Chicago, IL (US)

( * ) Notice: Subject to any disclaimer, the term of this patent is extended or adjusted under 35 U.S.C. 154(b) by 275 days.

(21) Appl. No.: 14/876,622

(22) Filed: Oct. 6, 2015

(65) Prior Publication Data

US 2017/0097142 A1 Apr. 6, 2017

(51) Int. Cl.

| | |
|---|---|
| ***F21V 17/00*** | (2006.01) |
| ***F21V 21/005*** | (2006.01) |
| ***F21V 15/015*** | (2006.01) |
| ***F21V 17/10*** | (2006.01) |
| *F21Y 103/00* | (2016.01) |

(52) U.S. Cl.

CPC ..... *F21V 17/005* (2013.01); *F21V 15/015* (2013.01); *F21V 17/104* (2013.01); *F21V 21/005* (2013.01); *F21Y 2103/00* (2013.01)

(58) Field of Classification Search

CPC .... F21V 17/005; F21V 21/005; F21V 15/015; F21V 17/06

See application file for complete search history.

(56) References Cited

U.S. PATENT DOCUMENTS

2015/0070882 A1* 3/2015 Ohno ..... F21K 9/20 362/219

* cited by examiner

*Primary Examiner* — Karabi Guharay
(74) *Attorney, Agent, or Firm* — Banner & Witcoff, Ltd.

(57) ABSTRACT

A concealed connection system for a luminaire that includes an inner joining member having a top surface, a bottom surface, a front surface, a rear surface, a first side surface having a first guide surface, and a second side surface having a second guide surface. An outer joining member having a top surface, a bottom surface, a base surface, a front surface, a rear surface, a first side surface, a second side surface, a first interior side surface opposite the first side surface having a first guide surface, and a second interior side surface opposite the second side surface having a second guide surface. The inner joining member may be slidably engaged along the guide surfaces onto the outer joining member, and the inner joining member may be secured to the outer joining member using a securing member.

20 Claims, 16 Drawing Sheets

CONCEALED CONNECTION SYSTEM FOR LUMINAIRES

BACKGROUND

Luminaires may come in a variety of sizes and shapes. Some luminaires may consist of a series of individual lighting fixtures connected together, allowing the fixtures to be manufactured in sections and then later assembled into a larger array or pattern of light fixtures. The housings of these light fixtures are typically connected together to create luminaires of different lengths and shapes. However, the assembly of the light fixtures to form an array or pattern can be difficult and time consuming, especially if several luminaires need to be joined together. A joining system and method that can easily align and connect the individual light fixtures together can decrease the time required to install the light fixtures. Additionally, a joint connection system is desired that will provide an aesthetically-pleasing look that provides a seamless connection with no visible fasteners. A joint connection system is also desired that provides a consistent, straight, and uniform alignment of the joined fixtures at the fixture joints, providing no gaps or visible joint seams.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

Aspects of this invention relate to systems and methods for connecting light fixtures to form a simple joint comprising an inner joining member and an outer joining member that slide together. A connection system for a luminaire may comprise: an inner joining member configured to attach to a light fixture that may comprise a top surface, a bottom surface, a front surface, a rear surface, a first side surface having a first guide surface, and a second side surface having a second guide surface, and an outer joining member configured to attach to a light fixture that may comprise a top surface, a bottom surface, a base surface, a front surface, a rear surface, a first side surface, a second side surface, a first interior side surface opposite the first side surface having a first guide surface, and a second interior side surface opposite the second side surface having a second guide surface. When assembled, the first guide surface of the inner joining member may be in communication with the first guide surface of the outer joining member and the second guide surface of the inner joining member is in communication with the second guide surface of the outer joining member. Similarly when assembled, the bottom surface of the inner joining member is in communication with the base surface of the outer joining member. Additionally, the inner joining member and the outer joining member are slidably engaged in a direction perpendicular to the base surface of the outer joining member. The connection system when assembled may create a concealed and seamless connection between the inner joining member and the outer joining member. The first guide surface of the inner joining member may form an angle with the front surface in a range of 1 degrees to 45 degrees.

Another aspect of this invention relates to where the inner joining member may also comprise a plurality of flanges along the top surface and a plurality of recesses in the top surface, where at least one of the recesses may have a front surface with an opening extending through at least a portion of the front surface of the recess. The outer joining member may further comprise a plurality of flanges along the top surface and a plurality of recesses in the top surface. When the connection system is assembled, the plurality of flanges on the inner joining member may confront the plurality of recesses on the outer joining member and the plurality of flanges on the outer joining member may confront the plurality of recesses on the inner joining member. In addition, the plurality of flanges and the plurality of recesses may be symmetrically located across a plane defined perpendicular to the front surface of the inner joining member and at a midpoint of a length of the top surface of the inner joining member. A securing member may be placed through an opening in at least one of the plurality of flanges of the inner joining member into a securing structure in the outer joining member.

Yet another aspect of this invention relates an to having a plurality of flanges on the inner joining member having an opening in at least one of the plurality of flanges of the inner joining member into a securing structure in the outer joining member. The opening in at least one of the plurality of flanges includes a countersink or a counter bore feature. Lastly, the inner joining member further comprises a first ramp surface that tapers from the first side surface to a recessed surface and is adjacent the first guide surface.

BRIEF DESCRIPTION OF THE DRAWINGS

The present invention is illustrated by way of example and not limited in the accompanying figures in which like reference numerals indicate similar elements and in which.

Figure 1:
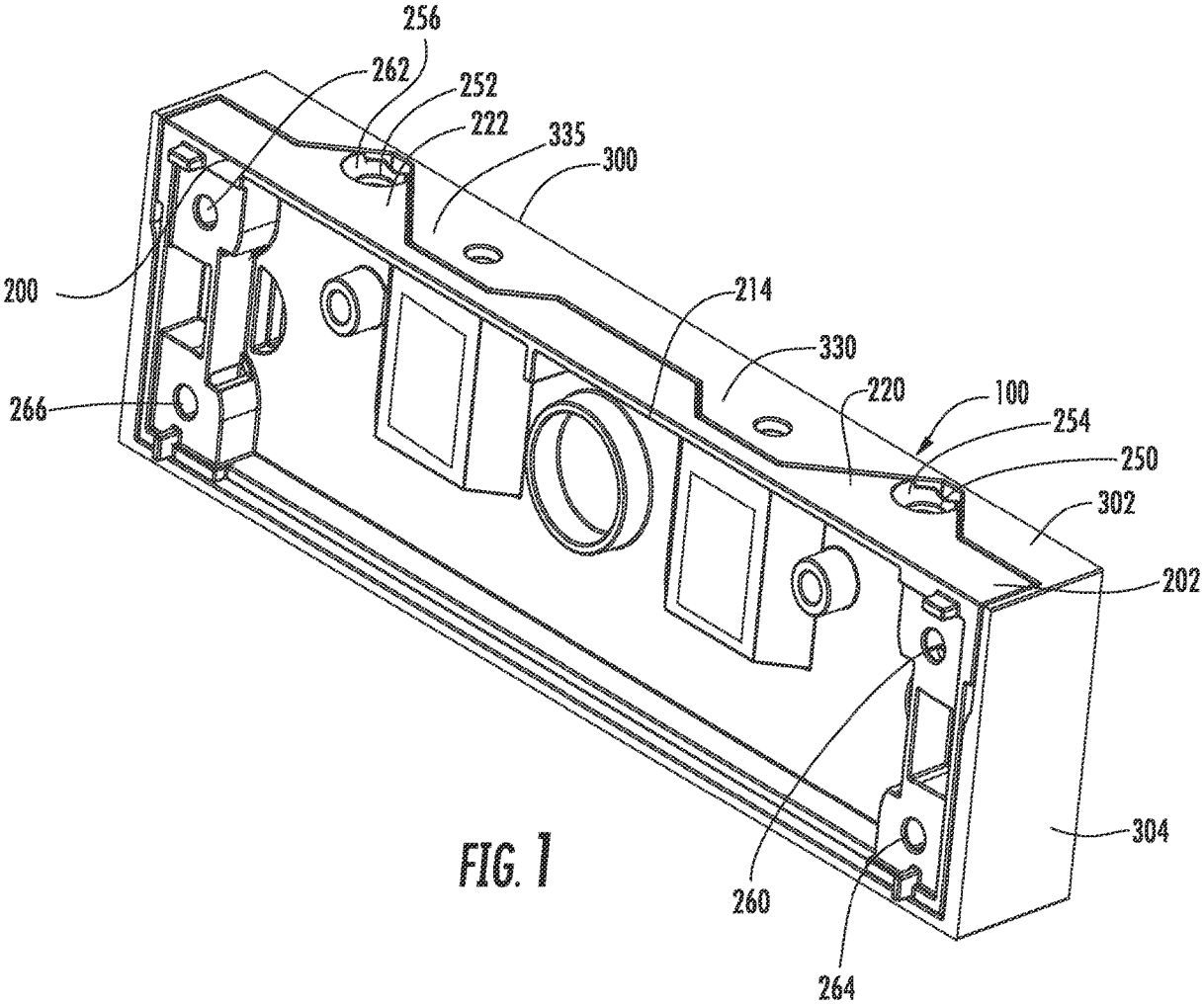
FIG. 1 illustrates an top front perspective view of an example embodiment of a connection system according to one or more aspects described herein.
Figure 2:
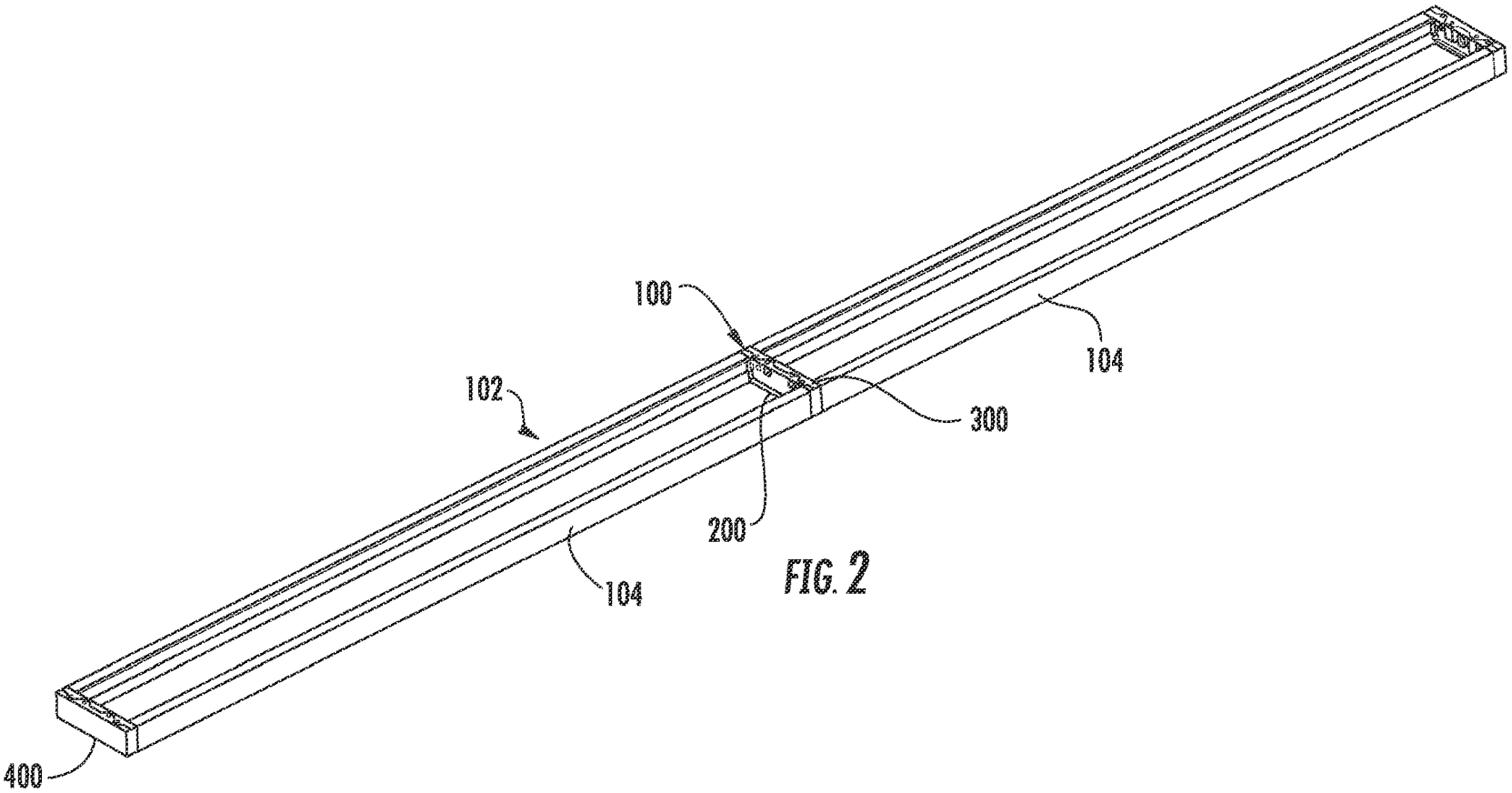
FIG. 2 illustrates a top front perspective view of an example embodiment of a lighting fixture assembly using an embodiment of the connection system according to one or more aspects described herein.

Further, it is to be understood that the drawings may represent the scale of different components of one single embodiment; however, the disclosed embodiments are not limited to that particular scale.

DETAILED DESCRIPTION

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Generally parallel" means that a first line, segment, plane, edge, surface, etc. is approximately (in this instance, within 5%) equidistant from with another line, plane, edge, surface, etc., over at least 50% of the length of the first line, segment, plane, edge, surface, etc.

"Generally perpendicular" means that a first line, segment, plane, edge, surface, etc. is approximately (in this instance, within 5%) oriented approximately 90 degrees from another line, plane, edge, surface, etc., over at least 50% of the length of the first line, segment, plane, edge, surface, etc.

"Plurality" indicates any number greater than one, either disjunctively or conjunctively, as necessary, up to an infinite number.

In the following description of the various embodiments, reference is made to the accompanying drawings, which form a part hereof, and in which is shown, by way of illustration, various embodiments in which aspects of the disclosure may be practiced. It is to be understood that other embodiments may be utilized and structural and functional modifications may be made without departing from the scope and spirit of the present disclosure.

In general, as described above, aspects of this invention relate to a system and method for connecting the housings of light fixtures to enable easy installation of the light fixtures using multiple runs. More detailed descriptions of aspects of this invention follow.

One aspect of this invention relates to a connection system for joining various light fixtures together. Such systems may include, for example (a) an inner joining member 200 having a top surface 202, a first side surface 204, a bottom surface 206, a second side surface 208, where each side surface 204, 208 has a recessed surface 210, 212 and a guide surface 280, 282; and (b) an outer joining member 300 having a top surface 302, a first exterior side surface 304 having an interior surface 316, a bottom surface 306, a second exterior side surface 308 having an interior surface 318 where each interior side surface 316, 318 has a recessed surface 310, 312 and a guide surface 380, 382.

FIG. 1 shows a perspective view of an example embodiment of the connection system 100. The inner joining member 200 is nested within the outer joining member 300 such that the inner joining member is not visible except from the top when the lighting fixtures are connected together. The connection system 100 may be primarily used for joining light fixtures. The example embodiment of the connection system 100 shown in FIG. 1 creates a joint to connect multiple light fixtures 102 as shown in FIGS. 2, 3, 3A, and 3B.

Figure 3:
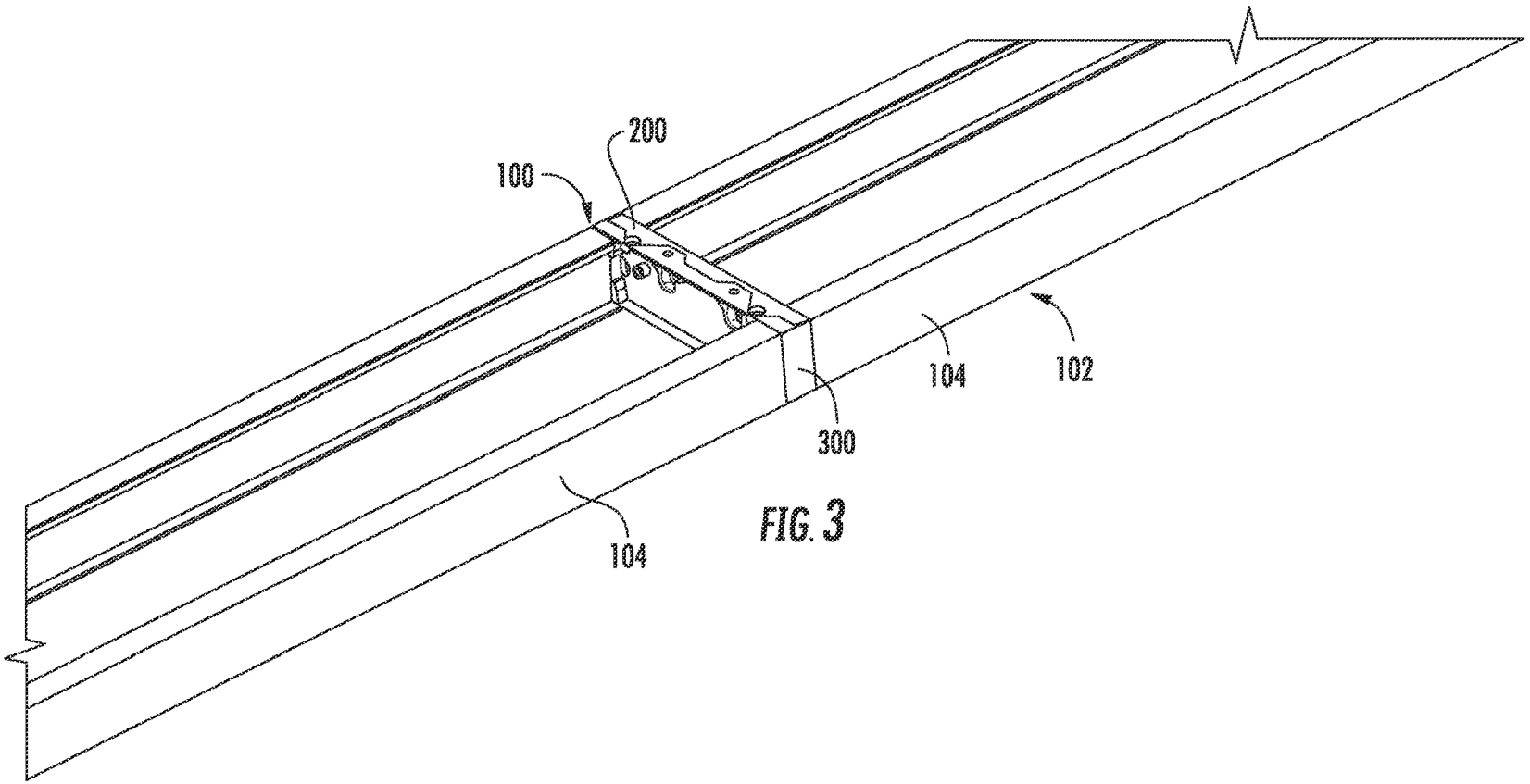
FIG. 3 illustrates a magnified view of the top front perspective view of FIG. 2.
Figure 3A:
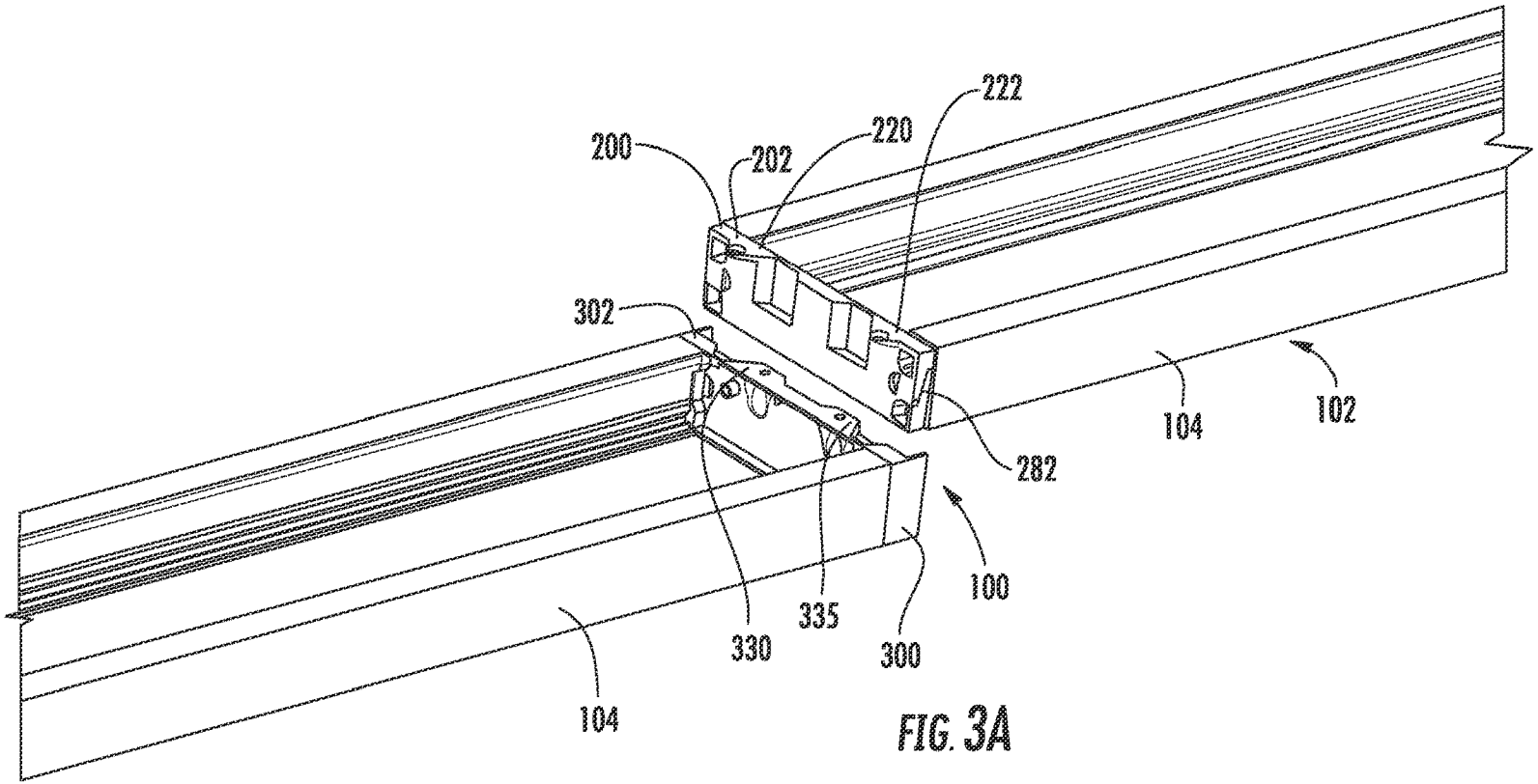
FIGS. 3A and 3B illustrate a top front perspective view of a partially assembled connection system of the example embodiment of FIG. 2
Figure 3B:
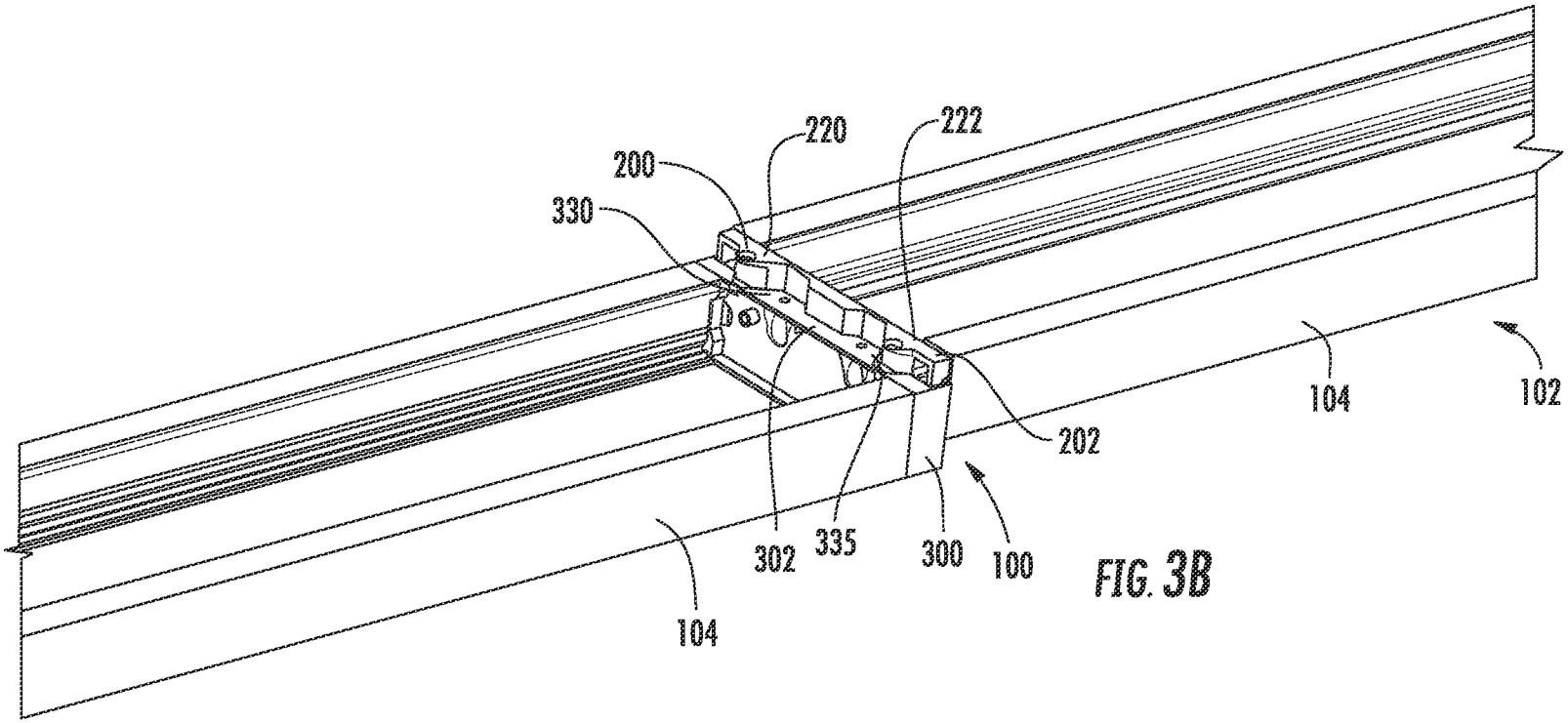

The inner joining member 200 and the outer joining member 300 may be slidably engaged as shown in FIGS. 3, 3A and 3B. The inner joining member 200 may be assembled to an end of a housing(s) 104 of a first light fixture 102. The outer joining member may be assembled to an end of a housing(s) 104 of a second light fixture 102. The outer joining member 300 may be connected by sliding the inner joining member 200 into the outer joining member 300 in a vertical direction where the guide surfaces 280, 282 are in communication with the guide surfaces 382, 380 respectively of the outer joining member 300, thereby joining the housing of the first light fixture 102 and the housing of the second light fixture 102.

As previously mentioned, both the inner joining member 200 and outer joining member 300 may have a plurality of guide surfaces to properly align the structures and inhibit rotation of the inner joining member 200 with respect to the outer joining member 300. Additionally, the guide surfaces of the inner joining member 200 and the outer joining member 300 pull together the joining members 200 300 and thus the housings 104 that each joining member 200, 300 is attached to, which further minimizes any gaps between the housing 104 and the joining members 200, 300 with the outer joining member 300 being drawn to the housing 104. For example, each side surface 204, 206 of the inner joining member 200 may have a guide surface 280, 282 in communication with guide surfaces 380, 382 of the outer joining member 300. More specifically, guide surface 280 of inner joining member 200 may confront guide surface 382 of outer joining member 300, and guide surface 282 of inner joining member 200 may confront guide surface 380 of outer joining member 300.

The outer joining member 300 may have a plurality of recesses 320, 322 positioned within the top surface 302 that receive at least a portion of a plurality of flanges 220, 222 of the inner surface 200. Also, the inner joining member 200 may have plurality of recesses 230, 235 in the top surface 202 that receive at least a portion of the plurality of flanges 330, 335 on the top surface 302. The plurality of flanges and recesses on both the inner joining member and the outer joining member may ensure the proper alignment and prevent rotation of the inner joining member 200 with respect to the outer joining member 300. The inner joining member 200 may be secured to the outer joining member 300 via plurality of securing members (not shown) such as a mechanical fastener installed through a plurality of holes 250, 252 of inner joining member 200 into a plurality of securing structures 350, 352 of outer joining member 300. The inner joining member 200 may securely engage the outer joining member 300 in only one orientation.

Inner Joining Member

Figure 6:
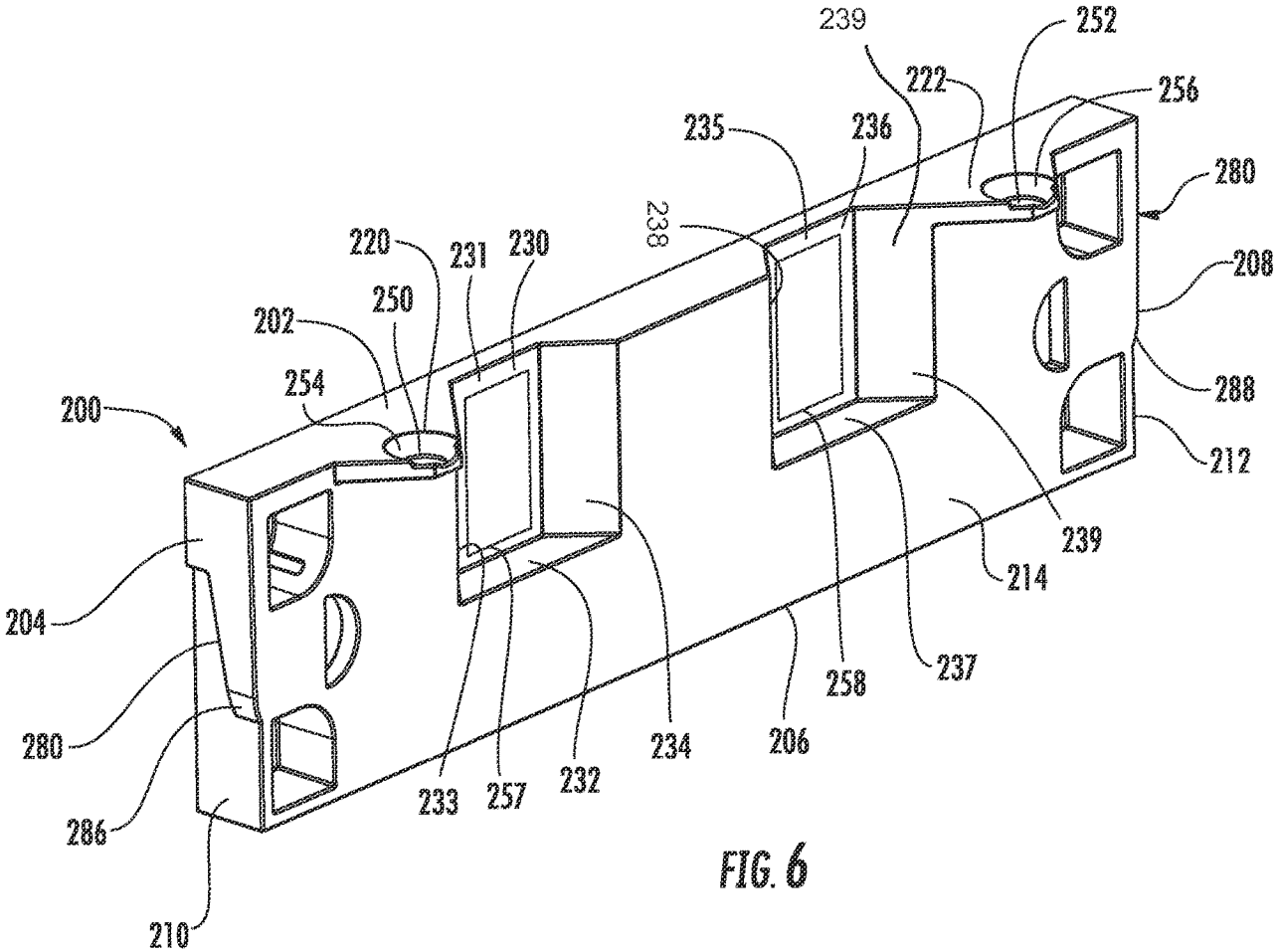
FIG. 6 illustrates a top front perspective view of a component of the connection system of FIG. 1.
Figure 7:
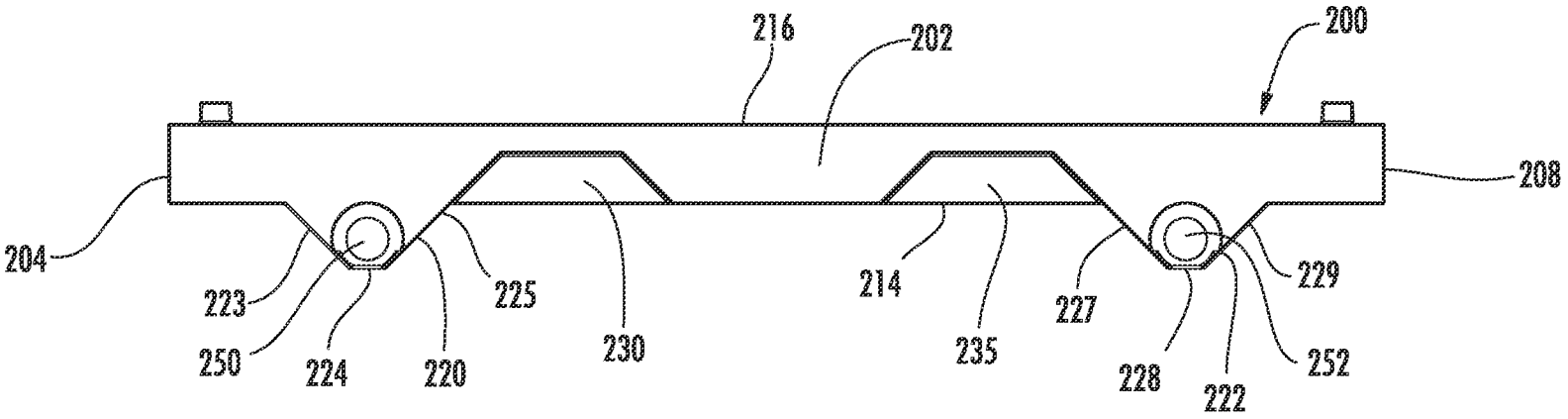
FIG. 7 illustrates a top view of the component of FIG. 6.
Figure 8:
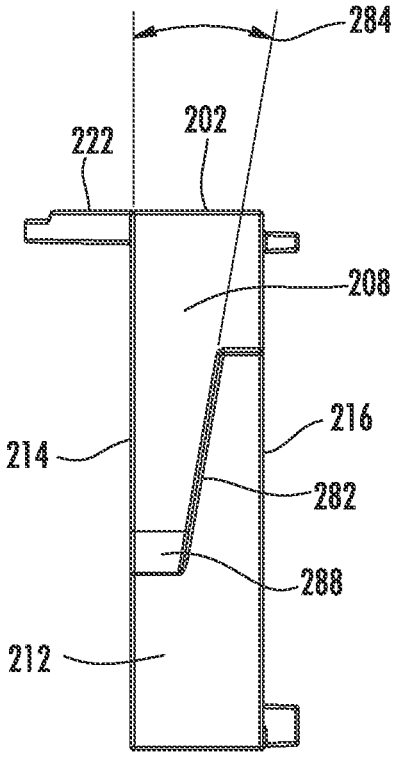
FIG. 8 illustrates a side view of the component of FIG. 6.

The inner joining member 200 shown individually in FIGS. 6-8 may comprise a top surface 202, a first side surface 204, a second side surface 208, and a bottom surface 206,where each side surface 204, 208 has a recessed surface 210, 212 and a guide surface 280, 282. Additionally, the top surface 202 may comprise a plurality of flanges 220, 222 and a plurality of recesses 230, 235. The guide surface 280 may connect between the side surface 204 and the recessed surface 210. Likewise, guide surface 282 may connect between the side surface 208 and the recessed surface 212. In addition, a ramp surface 286 may be adjacent to the guide surface 280 and taper from the side surface 204 and the recess surface 210. Similarly, a ramp surface 288 may be adjacent to the guide surface 282 and taper from the side surface 208 and the recess surface 212. The ramp surfaces 286, 288 may assist in further aligning and orienting the inner joining member 200 and outer joining member 300 as they engage each other.

As shown in FIG. 8, the guide surfaces 280, 282 may be positioned at an angle 284 defined from the front surface 214 to the guide surface, such that the guide surfaces 280, 282 may create a taper or wedge to align the inner joining member 200 to the outer joining member 300 and inhibit rotation of the inner joining member 200 with respect to the outer joining member 300 as the joining members are assembled. The guide surfaces 280, 282 may be positioned at the same angle, or alternatively, the guide surfaces may be positioned at different angles. The angle 284 may be within a range of 1 degree to 45 degrees. A variety of guide surfaces or other rotation inhibiting structures and systems may be used without departing from this invention including guide members that are asymmetrical such as having a differently shaped rotation inhibiting structure on the first side wall 204 than on the second side wall 208.

Each guide surface 280, 282 may have a sufficient width to provide an adequate non-rotational engagement. The width may be defined as the distance to from their respective side surfaces 204, 208 to their respective recessed surfaces 210, 212.

The inner joining member 200 may have a plurality of flanges 220, 222 on the top surface 202. Each flange 220, 222 may have a first angled surface 223, 227, a forward surface 224, 228, and a second angled surface 225, 229. The first flange 220 may have a first angled surface 223, a forward surface 224, and a second angled surface 225, where the forward surface 224 connects the first angled surface 223 and the second angled surface 225. Similarly, the second flange 222 may have a first angled surface 227, a forward surface 228, and a second angled surface 229, where the forward surface 228 connects the first angled surface 227 and the second angled surface 229.

Additionally, the flanges 220, 222 may have openings 250, 252 respectively to provide an access to install a securing member (not shown) into a securing structure on the outer joining member 300. The openings 250, 252 may be holes having a countersink or counterbore region 254, 256 respectively to keep the head of the fastener to lie flush or substantially flush with the top surface 202. The countersink, or counterbore region 254, 256 may be asymmetrical to further assist in aligning the joining members 200, 300 and pulling the joining members 200, 300 together to minimize any gaps between the housing 104 and the joining members 200, 300.

As described previously, the inner joining member 200 may also have a plurality of recesses 230, 235 in the top surface 202. The plurality of recesses 230, 235 may be positioned between the flanges 220, 222 such that the flanges are closer to the side surfaces 204, 208. Alternatively, the plurality of recesses 230, 235 may be positioned closer to the side surfaces 204, 208 than the flanges 220, 222. As another embodiment, each flange 220, 222 may have one flange closer to a side surface and one recess closer to the other side surface.

The first recess may be adjacent to the first flange 220 such that the second angled surface 225 may be coplanar with the first side surface 233. Additionally, the second recess 235 may be adjacent to the second flange 222 such that the first angled surface 227 may be coplanar with the second side surface 239. Alternatively, only one of the recesses may be adjacent to one of the flanges or neither of the recesses may be adjacent to one of the flanges.

The first recess 230 may comprise a first surface 231 offset the front wall 214, a bottom surface 232 offset from the top surface 202, and a first side wall 233 and a second side wall 234. Similarly, the second recess 235 may comprise a first surface 236 offset the front wall 214, a bottom surface 237 offset from the top surface 202, and a first side wall 238 and a second side wall 239. The first recess 230 and the second recess 235 may have the same shape. For instance, the first surfaces 231, 236 of each recess 230, 235 and may be coplanar, and the bottom surfaces 232, 237 may be also be coplanar.

The first surface 231 of the first recess 230 and the first surface 236 of the second recess 235 may each have an opening 257, 258 respectively. The openings 256, 258 may enable cabling to pass through. The openings 256, 258 may be of any shape or size. For example, the openings may have a round, oval, generally rectangular with rounded corners.

Figure 4:
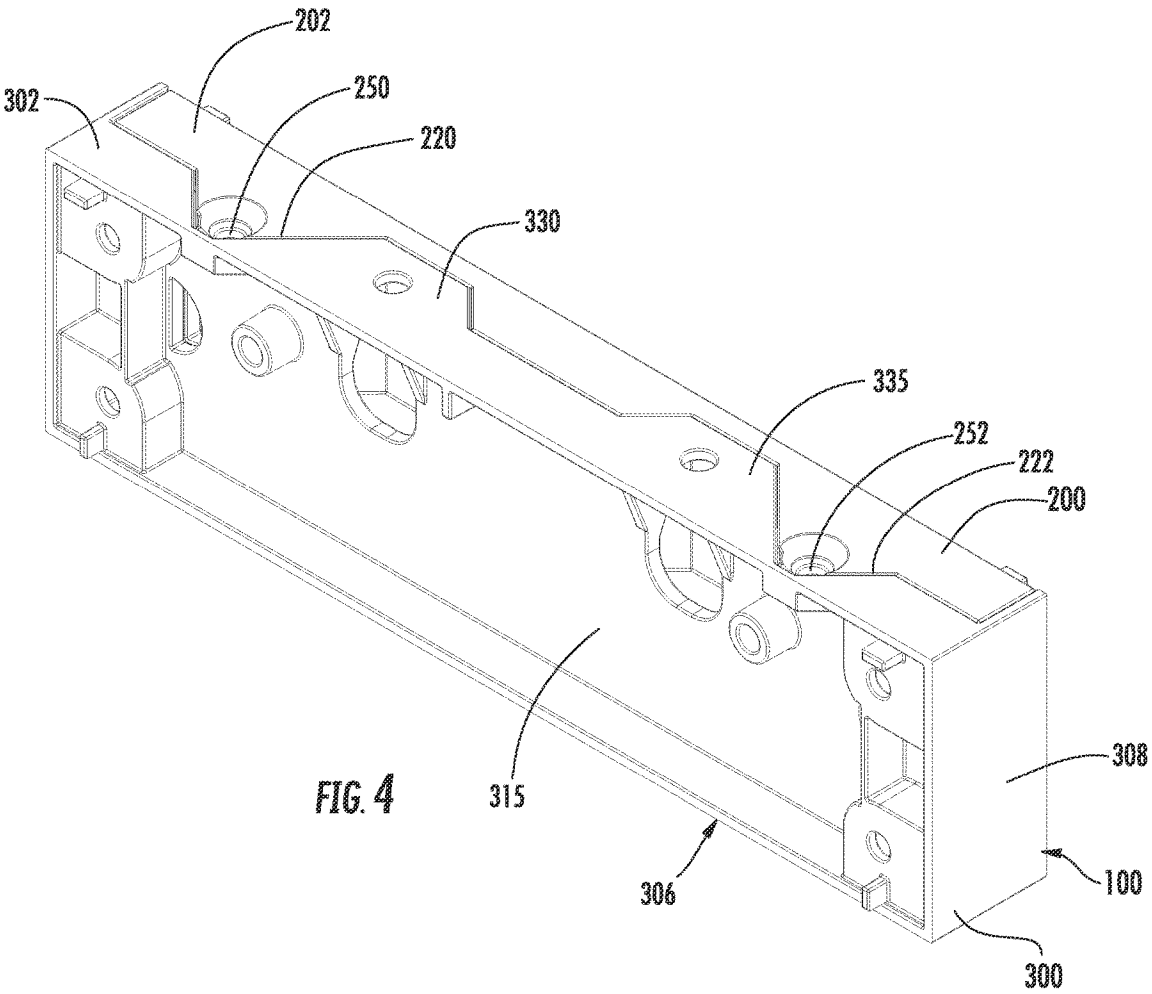
FIG. 4 illustrates a top rear perspective view of an example embodiment of a connection system of FIG. 1 according to one or more aspects described herein.
Figure 5:
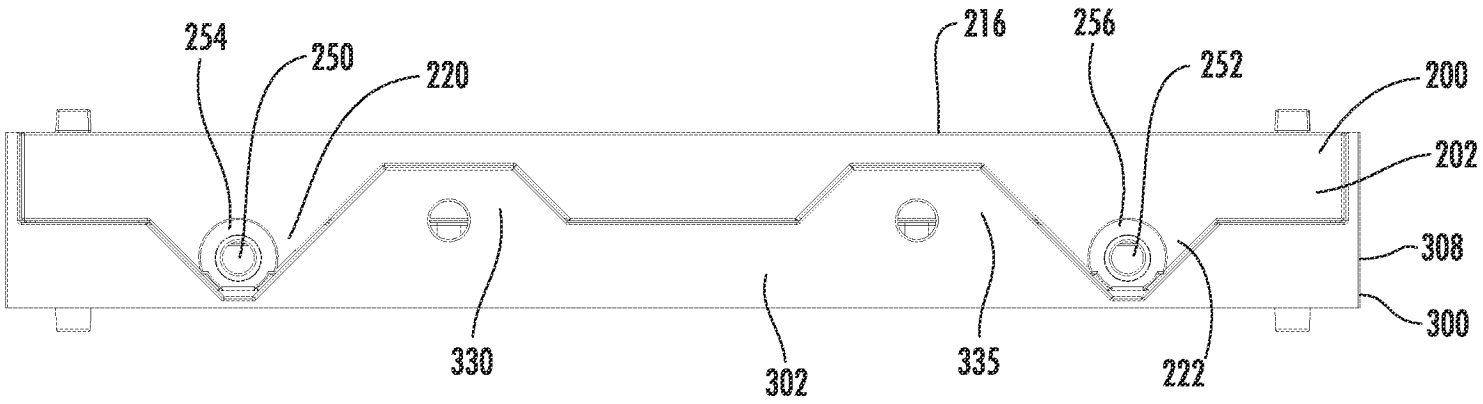
FIG. 5 illustrates a top view of the example embodiment of the connection system of FIG. 1.

As shown in FIGS. 1 and 7, the inner joining member 200 may have a plurality of engaging members positioned on at least a portion of the rear surface 216 and extending away from the surface 216. The plurality of engaging members are utilized for keyed and location alignment to ensure proper alignment and orientation of the inner joining member 200 and the housing(s) 104. These engaging members may engage features on the housing 104 to inhibit rotation as shown in FIG. 4.

Additionally, the inner joining member 200 may also have a plurality of holes 260, 262, 264, 266 extending through the inner joining member 200. Securing members (not shown) may be inserted through the plurality of holes 260, 262, 264, 266 and into corresponding securing structures (not shown) in the housing 104 of the light fixtures 102.

Outer Joining Member

Figure 9:
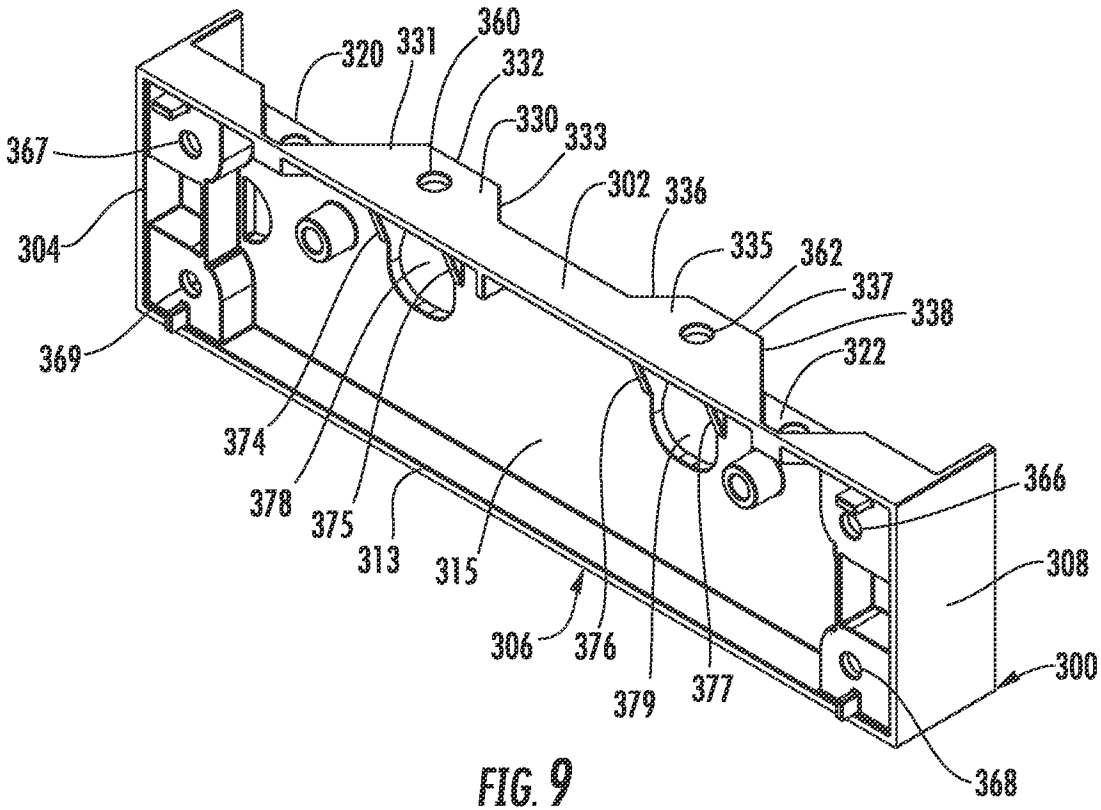
FIG. 9 illustrates a top front perspective view of a component of the connection system of FIG. 1.
Figure 10:
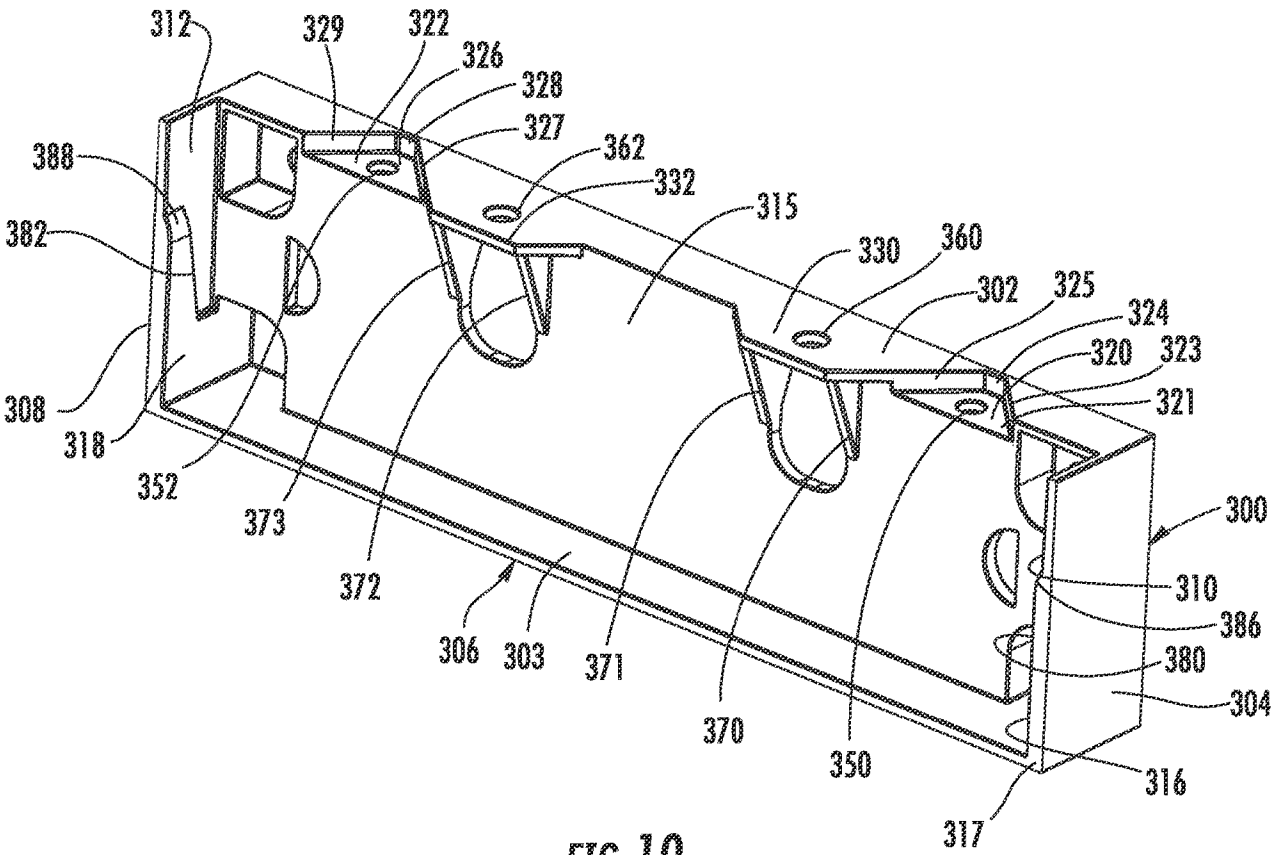
FIG. 10 illustrates a top rear perspective view of the component of FIG. 9.
Figure 11:
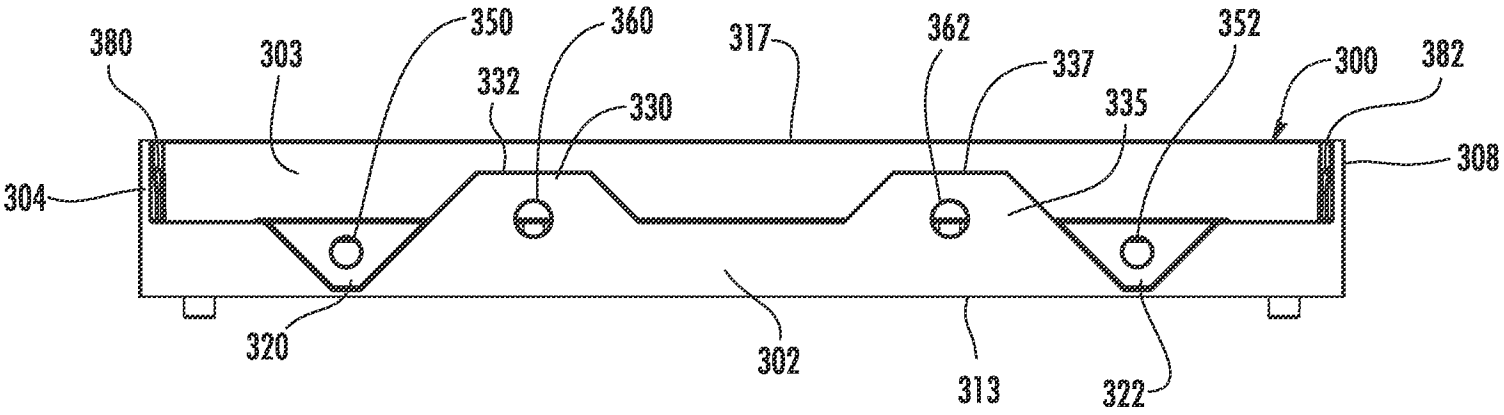
FIG. 11 illustrates a top view of the component of FIG. 9.

The outer joining member 300 shown individually in FIGS. 9-11 may comprise a top surface 302, a front surface 313, a central wall 315, a rear surface 317, a first side surface 304, a second side surface 308, a bottom surface 306, and a base surface 303 opposite the bottom surface 306, where each side surface 304, 308 has an interior surface 316, 318 with a recessed surface 310, 312 and a guide surface 380, 382. Additionally, the top surface 302 may comprise a plurality of flanges 330, 335 and a plurality of recesses 320, 322. The guide surface 380 may connect between the side surface 304 and the recessed surface 310. Likewise, guide surface 382 may connect between the side surface 308 and the recessed surface 312. In addition, a ramp surface 386 may be adjacent to the guide surface 380 and taper from the side surface 304 and the recess surface 310. Similarly, a ramp surface 388 may be adjacent to the guide surface 382 and taper from the side surface 308 and the recess surface 312. The ramp surfaces 386, 388 may assist in further aligning and orienting the inner joining member 200 and outer joining member 300 as they engage each other.

Similar to the guide surfaces 280, 282 on the inner joining member 200, the guide surfaces 380, 382 may be positioned at an angle defined from the front surface 313 to the guide surface, such that the guide surfaces 380, 382 may create a taper or wedge to align the inner joining member 200 to the outer joining member 300 and inhibit rotation of the inner joining member 200 with respect to the outer joining member 300 as the structures are assembled. The guide surfaces 380, 382 may be positioned at the same angle, or alternatively, the guide surfaces may be positioned at different angles. The angle may be within a range of 1 degree to 45 degrees. A variety of guide surfaces or other rotation inhibiting structures and systems may be used without departing from this invention including rotation inhibiting structures that are asymmetrical having a differently shaped guide surface on the first side wall 304 than on the second side wall 308.

Each guide surface 380, 382 may have a width defined as the distance to from their respective interior side surfaces 316, 318 to their respective recessed surfaces 310, 312. Additionally, the guide surfaces of the inner joining member 200 and the outer joining member 300 pull together the joining members 200 300 and thus the housing(s) 104 that each joining member 200, 300 is attached to, which further minimizes any gaps between the housing(s) 104 and the joining members 200, 300 with the outer joining member 300 being drawn to the housing(s) 104.

The outer joining member 300 may have a plurality of flanges 330, 335 on the top surface 302. Each flange 330, 335 may have a first surface 331, 336, a forward surface 332, 337, and a second surface 333, 338. The first flange 330 may have a first surface 331, a forward surface 332, and a second surface 333, where the forward surface 332 connects the first surface 331 and the second surface 333. Similarly, the second flange 335 may have a first surface 336, a forward surface 337, and a second surface 338, where the forward surface 337 connects the first surface 336 and the second surface 338. Lastly, the flanges 330, 335 may have openings 360, 362 respectively.

As shown in FIGS. 9 and 10, each flange 330, 335 may be supported by a plurality of gussets 370, 371, 372, 373, 374, 375, 376, 377 connected from a central wall 315 to the underside of the flanges. The gussets may be positioned on both sides of the central wall 315. Additionally, a plurality of openings 378, 379 may be located through the central wall 315 proximate the plurality of gussets 370, 371, 372, 373.

As described previously, the outer joining member 300 may also have a plurality of recesses 320, 322 in the top surface 302. The plurality of recesses 320, 322 may be positioned outside the flanges 330, 335 such that the recesses 320, 322 are proximate the side surfaces 304, 308. Alternatively, the plurality of recesses 320, 322 may be positioned between the flanges 330, 335 where flanges 330, 335 are closer to the side surfaces 304, 308 than the recesses 320, 322. As another embodiment, each recess 320, 322 may have one flange closer to a side surface and one recess closer to the other side surface.

The first recess 320 may be adjacent to the first flange 330 such that its first side surface 331 may be coplanar with the second side surface 325 of the first recess 320. Additionally, the second recess 322 may be adjacent to the second flange 335 such that its second side surface 338 may be coplanar with the first side surface 327 of the recess 322. Alternatively, only one of the recesses may be adjacent to one of the flanges or neither of the recesses may be adjacent to one of the flanges.

The first recess 320 may comprise a first surface 324 offset the rear wall 316, a bottom surface 321 offset from the top surface 202, and a first side surface 323 and a second side wall 325. Similarly, the second recess 322 may comprise a first surface 328 offset the rear wall 316, a bottom surface 326 offset from the top surface 302, and a first side wall 327 and a second side wall 329. The first recess 320 and the second recess 322 may have the same size and shape. For instance, the first surfaces 324, 328 of each recess 320, 322 may be coplanar, and the bottom surfaces 321, 326 may be also be coplanar. Additionally, the width measured at the widest portion of each recess may be the same.

The bottom surface 321 of the first recess 320 and the bottom surface 236 of the second recess 322 may each have a securing structure 350, 352 respectively. The securing structures 350, 352 may comprise a threaded hole to receive a mechanical fastener.

As shown in FIGS. 4 and 10, the outer joining member 300 may have a plurality of engaging members positioned extending away from and beyond the front surface 313. These engaging members may engage features on the housing(s) 104 to inhibit rotation of the housing when it is connected to the outer joining member 300.

Each engaging member may have an engaging surface designed to communicate with a surface on the housing(s) 104. The plurality of engaging members are utilized for keyed and location alignment to ensure proper alignment and orientation of the outer joining member 300 and the housing(s) 104.

Additionally, the outer joining member 300 may also have a plurality of holes 366, 367, 368, 369 extending through the outer joining member 300. Securing members (not shown) may be inserted into the plurality of holes into corresponding securing structures (not shown) in the housing 104.

In addition, the outer joining member 300 may have a plurality of exterior surfaces 304, 306, 308 that have a smooth surface free of any features to provide the desired aesthetic appearance. Alternatively, the exterior surfaces 304, 306, 308 may have a textured or patterned surface finish.

Figure 12:
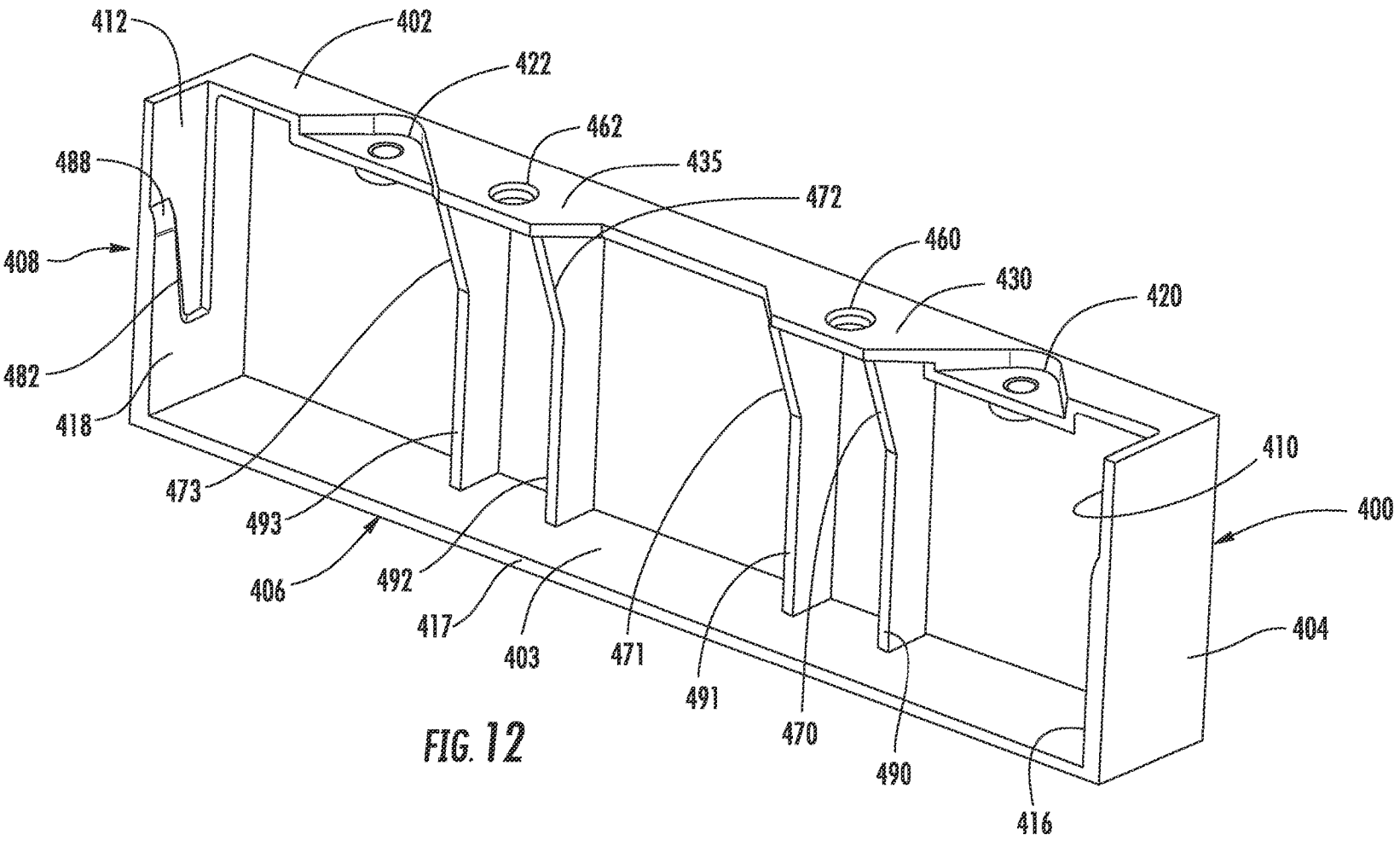
FIG. 12 illustrates a top front perspective view of an alternate embodiment of the component of FIG. 9.
Figure 13:
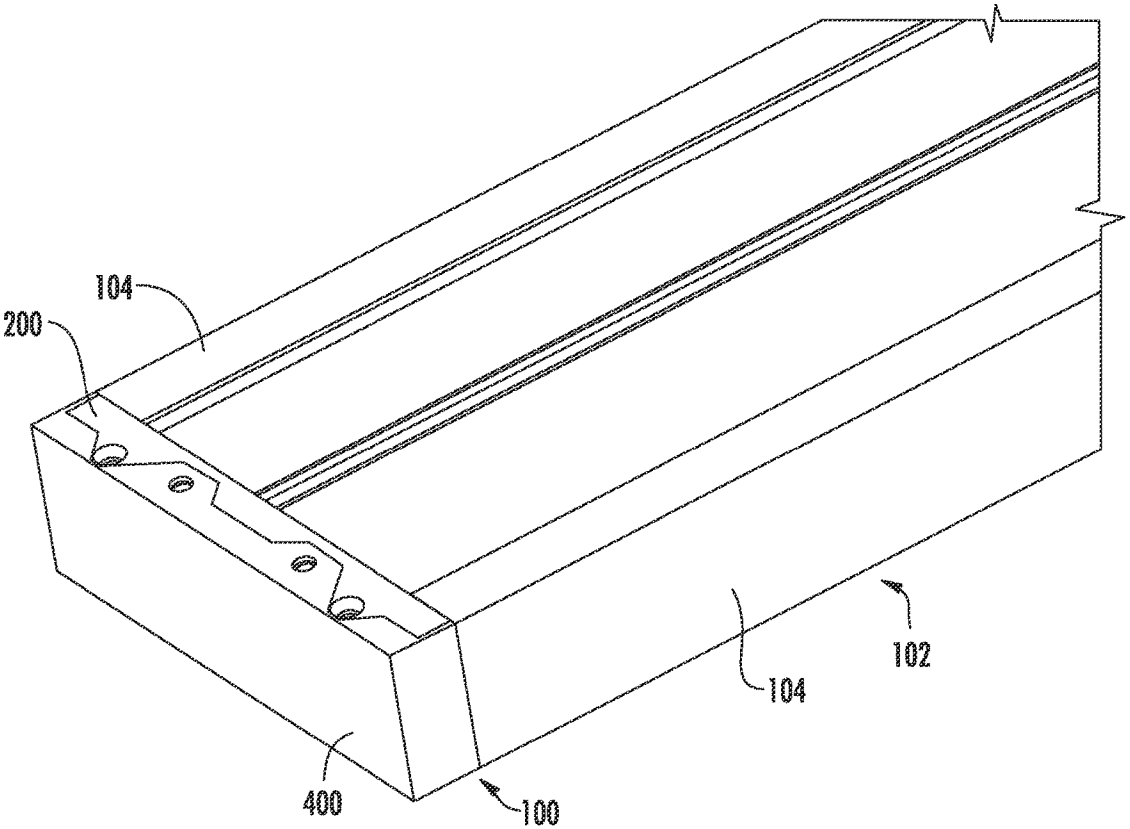
FIG. 13 illustrates a top rear perspective view of an example embodiment of a lighting fixture assembly using an alternate embodiment of the connection system according to one or more aspects described herein.
Figure 14:
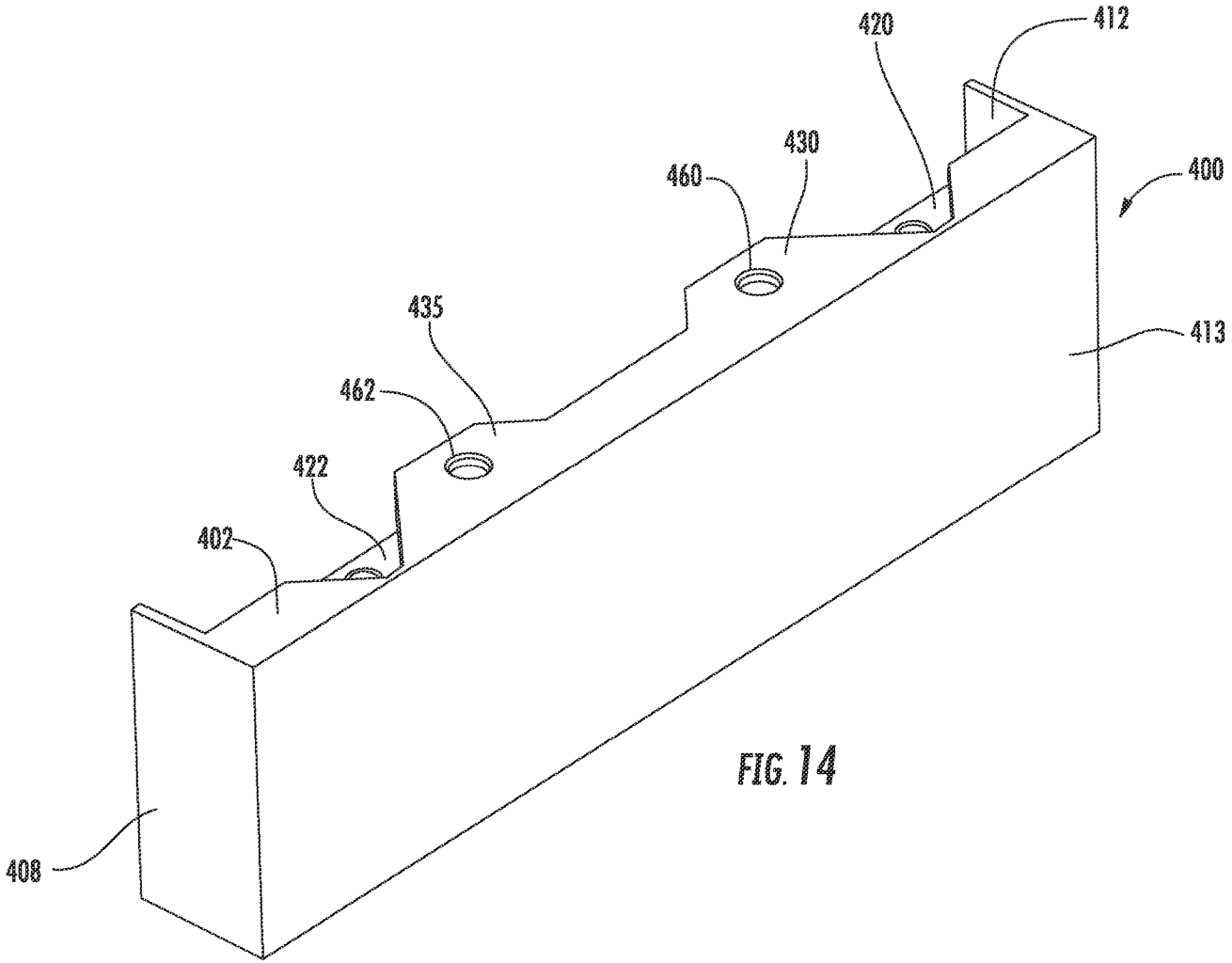
FIG. 14 illustrates a top rear perspective view of the component of FIG. 12.

FIGS. 12-14 show an alternate embodiment of outer joining member 400. For the embodiment of FIGS. 12-14, the features are referred to using similar reference numerals under the "4XX" series of reference numerals, rather than "3XX" as used in the embodiment of FIGS. 1-11. Accordingly, certain features of the outer joining member 400 that were already described above with respect to outer joining member 300 of FIGS. 12-14 may be described in lesser detail, or may not be described at all. Outer joining member 400 may connect to the inner joining member 200 in the same manner as the outer joining member 300. Outer joining member 400 may be positioned on the light fixture 102 to create an end cap shown in FIG. 13. The outer joining member 400 may comprise a top surface 402, a front surface 413, a rear surface 417, a first side surface 404, a second side surface 408, a bottom surface 406, and a base surface 403 opposite the bottom surface 406, where each side surface 404, 408 has an interior surface 416, 418 with a recessed surface 410, 412 and a guide surface 480, 482. Additionally, the top surface 402 may comprise a plurality of flanges 430, 435 and a plurality of recesses 420, 422. The guide surface 480 may connect between the side surface 404 and the recessed surface 310. Likewise, guide surface 482 may connect between the side surface 408 and the recessed surface 412. In addition, a ramp surface 486 may be adjacent to the guide surface 480 and taper from the side surface 404 and the recess surface 410. Similarly, a ramp surface 488 may be adjacent to the guide surface 482 and taper from the side surface 408 and the recess surface 412.

Unlike outer joining member 300, the front surface 413 may be a smooth surface free of any features to provide the desired aesthetic appearance. Alternatively, the front surface 413 may have a textured or patterned surface finish.

As shown in FIG. 12, each flange 430, 435 may be supported by a plurality of gussets 470, 471, 472, 473 connected to an interior surface of the front surface 413 to the underside of the flanges. The gussets 470, 471, 472, 473 may connect to a plurality of ribs 490, 491, 492, 493 respectively extending along the interior surface to the base surface 403.

Materials

According to various aspects and embodiments, the inner joining member 200 and the outer joining member 300 may be formed of one or more of a variety of metallic materials (including metal alloys), such as, but not limited to, aluminum, aluminum alloys, steels (including stainless steels), titanium, and titanium alloys. The inner joining member 200 and the outer joining member 300 may also be formed of one or more of a variety of non-metallic materials, such as polymers, and composites (including fiber-reinforced composites) and may be formed in one of a variety of configurations, without departing from the scope of the invention. In one illustrative embodiment, both the inner joining member 200 and outer joining member 300 are made of metal. It is understood that the inner joining member 200 and outer joining member 300 may contain components made of several different materials, including fiber reinforced polymers, carbon-fiber composites, or other similar materials.

The inner joining member 200 and outer joining member 300 may be formed by various forming methods. For example, metal components, such as components made from titanium, aluminum, titanium alloys, aluminum alloys, steels (including stainless steels), and the like, may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques. In a further example, polymer components, such as high strength polymers, can be manufactured by polymer processing techniques, such as various molding and casting techniques and/or other known techniques. If either of the inner joining member 200 or outer joining member 300 is made of non-metallic materials, they may have a metallic coating to improve the strength and durability of the components.

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. A concealed connection system for a luminaire, comprising:

an inner joining member configured to attach to a first light fixture, the inner joining member comprising a top surface, a bottom surface, a front surface, a rear surface, a first side surface having a first guide surface, a second side surface having a second guide surface;

an outer joining member configured to attach to a second light fixture, the outer joining member comprising a top surface, a bottom surface, a base surface, a front surface, a rear surface, a first side surface, a second side surface, a first interior side surface opposite the first side surface having a first guide surface, a second interior side surface opposite the second side surface having a second guide surface;

wherein when assembled the first guide surface of the inner joining member is in communication with the first guide surface of the outer joining member and the second guide surface of the inner joining member is in communication with the second guide surface of the outer joining member; and wherein the inner joining member and the outer joining member are slidably engaged in a direction perpendicular to the base surface of the outer joining member, thereby connecting the first light fixture to the second light fixture and further wherein the first and second side surfaces of the outer joining member extend past and cover the first and second side surfaces of the inner joining member thereby creating a concealed and seamless connection between the inner joining member and the outer joining member.

2. A concealed connection system for a luminaire of claim 1, wherein the first guide surface of the inner joining member forms an angle with the front surface.

3. A concealed connection system for a luminaire of claim 1, wherein the bottom surface of the inner joining member is in communication with the base surface of the outer joining member.

4. A concealed connection system for a luminaire of claim 1, wherein the inner joining member further comprises a plurality of flanges along the top surface and a plurality of recesses in the top surface.

5. A concealed connection system for a luminaire of claim 1, wherein the inner joining member further comprises a plurality of flanges along the top surface and a plurality of recesses in the top surface and the outer joining member further comprises a plurality of flanges along the top surface and a plurality of recesses in the top surface;

wherein when assembled the plurality of flanges on the inner joining member confront the plurality of recesses on the outer joining member and the plurality of flanges on the outer joining member confront the plurality of recesses on the inner joining member.

6. A concealed connection system for a luminaire of claim 5, wherein a securing member is placed through an opening in at least one of the plurality of flanges of the inner joining member into a securing structure in the outer joining member.

7. A concealed connection system for a luminaire of claim 6, wherein the opening in at least one of the plurality of flanges includes a countersink feature.

8. A concealed connection system for a luminaire of claim 6, wherein the opening in at least one of the plurality of flanges includes a counterbore feature.

9. A concealed connection system for a luminaire of claim 1, wherein the inner joining member further comprises a plurality of recesses from the top surfaces wherein each recess has a front surface containing an opening extending through at least a portion of the front surface.

10. A concealed connection system for a luminaire of claim 1, wherein the inner joining member further comprises a first ramp surface that tapers from the first side surface to a recessed surface and is adjacent the first guide surface.

11. A concealed connection system for a luminaire, comprising:

an inner joining member comprising a top surface, a bottom surface, a front surface, a rear surface, a first side surface having a first guide surface, a second side surface having a second guide surface, a plurality of flanges along the top surface and a plurality of recesses in the top surface;

an outer joining member comprising a top surface, a bottom surface, a base surface, a front surface, a rear surface, a first side surface, a second side surface, a first interior side surface opposite the first side surface having a first guide surface, a second interior side surface opposite the second side surface having a second guide surface, a plurality of flanges along the top surface and a plurality of recesses in the top surface;

wherein when assembled the plurality of flanges on the inner joining member confront the plurality of recesses on the outer joining member and the plurality of flanges on the outer joining member confront the plurality of recesses on the inner joining member;

wherein when assembled the first guide surface of the inner joining member is in communication with the first guide surface of the outer joining member and the second guide surface of the inner joining member is in communication with the second guide surface of the outer joining member, and further wherein the first and second side surfaces of the outer joining member extend past and cover the first and second side surfaces of the inner joining member thereby creating a concealed and seamless connection between the inner joining member and the outer joining member.

12. A concealed connection system for a luminaire of claim 11, wherein the inner joining member and the outer joining member are slidably engaged in a direction perpendicular to the base surface of the outer joining member.

13. A concealed connection system for a luminaire of claim 11, wherein the first guide surface of the inner joining member forms an angle with the front surface.

14. A concealed connection system for a luminaire of claim 11, wherein the bottom surface of the inner joining member is in communication with the base surface of the outer joining member.

15. A concealed connection system for a luminaire of claim 11, wherein the plurality of flanges and the plurality of recesses are symmetrically located across a plane defined perpendicular to the front surface of the inner joining member and at a midpoint of a length of the top surface of the inner joining member.

16. A concealed connection system for a luminaire of claim 11, wherein a securing member is placed through an opening in at least one of the plurality of flanges of the inner joining member into a securing structure in the outer joining member.

17. A concealed connection system for a luminaire of claim 16, wherein the opening in at least one of the plurality of flanges includes a countersink feature.

18. A concealed connection system for a luminaire of claim 17, wherein the opening in at least one of the plurality of flanges includes a counterbore feature.

19. A concealed connection system for a luminaire of claim 11, wherein the inner joining member further comprises a first ramp surface that tapers from the first side surface to a recessed surface and is adjacent the first guide surface.

20. A concealed connection system for a luminaire, comprising:

an inner joining member comprising a top surface, a bottom surface, a front surface, a rear surface, a first side surface having a first guide surface, a second side surface having a second guide surface, a plurality of flanges along the top surface and a plurality of recesses in the top surface;

an outer joining member comprising a top surface, a bottom surface, a base surface, a front surface, a rear surface, a first side surface, a second side surface, a first interior side surface opposite the first side surface having a first guide surface, a second interior side surface opposite the second side surface having a second guide surface, a plurality of flanges along the top surface and a plurality of recesses in the top surface;

wherein when assembled the plurality of flanges on the inner joining member confront the plurality of recesses on the outer joining member and the plurality of flanges on the outer joining member confront the plurality of recesses on the inner joining member;

wherein when assembled the first guide surface of the inner joining member is in communication with the first guide surface of the outer joining member and the second guide surface of the inner joining member is in communication with the second guide surface of the outer joining member and further wherein the first and second side surfaces of the outer joining member extend past and cover the first and second side surfaces of the inner joining member thereby creating a concealed and seamless connection between the inner joining member and the outer joining member; and wherein the inner joining member further comprises a first ramp surface that tapers from the first side surface to a recessed surface and is adjacent the first guide surface.

* * * * *